United States Patent [19]

Hopper

[11] Patent Number: 5,002,129

[45] Date of Patent: Mar. 26, 1991

[54] REMOVABLE GUIDE POST

[75] Inventor: Hans P. Hopper, Whiterashes, Scotland

[73] Assignee: British Petroleum Co. p.l.c., Cleveland, Ohio

[21] Appl. No.: 447,307

[22] Filed: Dec. 7, 1989

[30] Foreign Application Priority Data

Dec. 8, 1988 [GB] United Kingdom ..... 8828654

[51] Int. Cl.[5] ..... E21B 23/00; E02D 27/24; E02D 29/00; F16L 37/084

[52] U.S. Cl. ..... 166/338; 166/339; 166/340; 285/308; 285/321; 405/195

[58] Field of Search ..... 166/338–340, 166/342, 343, 349, 351, 359, 360, 365; 405/168, 169, 188, 195; 285/149, 308, 318, 321, 315, 316

[56] References Cited

U.S. PATENT DOCUMENTS

| | | | |
|---|---|---|---|
| 3,250,331 | 5/1966 | Boyle | 285/315 |
| 3,350,130 | 10/1967 | Ahlstone et al. | 166/351 |
| 4,405,263 | 9/1983 | Hall | 405/224 |
| 4,439,068 | 3/1984 | Pokladnik | 405/169 |
| 4,570,977 | 2/1986 | Burton et al. | 285/39 |
| 4,799,816 | 1/1989 | Lechon et al. | 403/2 |
| 4,848,472 | 7/1989 | Hopper | 166/344 |

*Primary Examiner*—Stephen J. Novosad

*Attorney, Agent, or Firm*—Raymond F. Keller; David J. Untener; Larry W. Evans

[57] ABSTRACT

Guide posts for any part of a sub-sea oil or gas installation can be installed in or removed from a guide foot solely by vertical movement. The guide post end has a surrounding locking sleeve capable of sliding axially relative to the guide post end and there is at least one locking mechanism formed of a ring or segments on the guide post and co-operating with at least one groove in the guide foot. Upward movement of the guide post end relative to the locking sleeve locks the mechanism, and upward movement of the locking sleeve relative to the guide post end unlocks it. The mechanism may be automatically reset by the unlocking action so that guide posts may be transferred underwater without being brought back to the surface, although damaged posts can always be retrieved if required. Tools for unlocking and removing the guide posts are also described, one of the tools being capable of dealing with bent guide posts.

12 Claims, 7 Drawing Sheets

REMOVABLE GUIDE POST

This invention relates to a removable guide post for a sub-sea oil or gas installation or module thereof.

Guide posts are frequently used to locate components on sea-bed bases during oil drilling or production operations or to locate one module on top of another. For example, for the drilling of a sub-sea well a guide base is normally positioned around the conductor housing of a well to be drilled. The guide base has guide posts and these are used to position a drilling blow out preventer on top of the well head. Guide posts may also be used to install and position other modules, e.g. to guide and position a lower riser package on a drilling blow out preventer, a work over blow out preventer on a well tree, or an emergency disconnect package on a workover blow out preventer.

Guide bases currently used for sub-sea drilling are so-called permanent guide bases, i.e. once installed they cannot be subsequently be removed for re-use or repair unless the well is abandoned. If a guide post of such a permanent guide base were to become bent or damaged at any time during placement or use, the drilling operation would be seriously disrupted. Some permanent guide bases have posts which are bolted on or held by friction screws and, theoretically, it should be possible to replace guide posts on such guide bases. It could be done, for example, by divers at diver depths, but at greater depths it would have to be done by an ROV and this could be a difficult and intricate operation.

If a guide post is bent or damaged, it must necessarily be brought back up to the surface for repair or replacement. In such circumstances it does not matter if the mechanism for locking this guide posts into the guide base or other module has to be re-set on the surface before the guide post can be re-used.

However, there may bs instances when the transfer of an undamaged guide post from one part of a sea-bed complex to another may be required, without necessarily bringing it to the surface. One example of a possible transfer would be in a multi-well sea-bed complex, when the guide posts on a multi-well template could be transferred after completion of the drilling of a well to an adjacent well slot.

Guide post ends capable of such a sub-sea transfer must be capable of automatic re-setting.

The present invention is concerned with a removable guide post which can be placed and removed by vertical movement only without the need for any locking by bolts or screws. It is particularly concerned with a removable guide post the locking mechanism of which automatically resets when the post is removed, so that the post can be moved from point to point of a sub-sea installation without being brought back to the surface. It is also concerned with a removable guide post which locks and unlocks but the mechanism of which does not automatically re-set when the post is removed. This simpler design could be used on any installation where sub-sea transfer of guide posts is not required, or could be used initially on a more complex installation, and replaced with a re-settable type of post at the stage when guide post transfer becomes desirable.

Either design can, of course, be removed and brought to the surface in the case of damage, and then repaired or replaced.

According to the present invention a removable guide post assembly suitable for a sub-sea oil or gas installation comprises (a) a guide foot having a vertical hole to receive the end of a guide post, said foot having at least one horizontal groove on its inner surface, (b) a guide post end capable of fitting within the guide foot and having a locking ring or locking segments adapted to fit into the horizontal groove, (c) a locking sleeve surrounding the guide post end capable of relative axial movement with respect to the guide post end, and (d) temporary locking means on the locking sleeve capable of locking the sleeve into the guide foot, so that upward movement of the guide post end relative to the locking sleeve locks the locking ring or locking segments into the groove of the guide foot and hence the guide post end into the guide foot, and upward movement of the locking sleeve relative to the guide post end releases the locking ring or locking segments and frees the guide post end from the guide foot.

In the non-resettable mechanism the temporary locking means for the locking sleeve in the guide foot may be one or more shear pins which are sheared by upward movement of the locking sleeve. In the resettable mechanism, they may be spring loaded lock pins which are released from their temporary lock into the guide foot by the locking upward movement of the guide post end.

In the non-resettable mechanism there need be no locking means between the locking sleeve and the guide post end. In the resettable mechanism, however, the guide post end may have a locking split ring in a circumferential groove and the locking sleeve may have an inner groove with locking pins capable of pushing the locking split ring from the locking sleeve inner groove back into the circumferential groove of the guide post end.

The invention is illustrated with reference to the accompanying drawings in which FIG. 1 is a section through a guide foot and a resettable, removable guide post according to the present invention, FIGS. 2A, 2B, 2C and 2D show the sequence of operations when locking and unlocking the re-settable, removable guide post of FIG. 1.

Figure 6A:
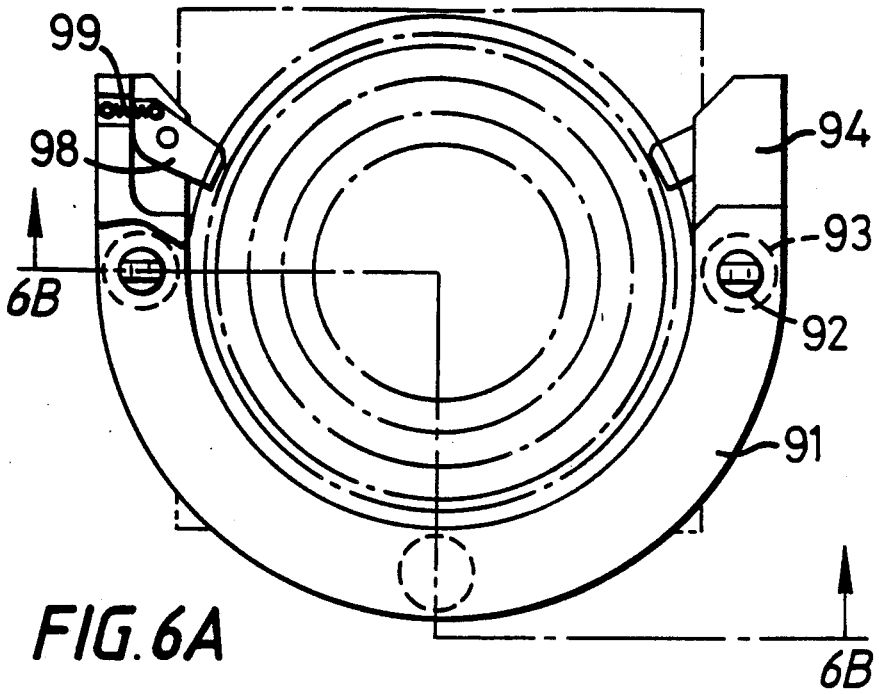
FIG. 6A is a plan view and FIG. 6B a partially sectioned view of a guide post retrieval tool operable by a ROV.
Figure 6B:
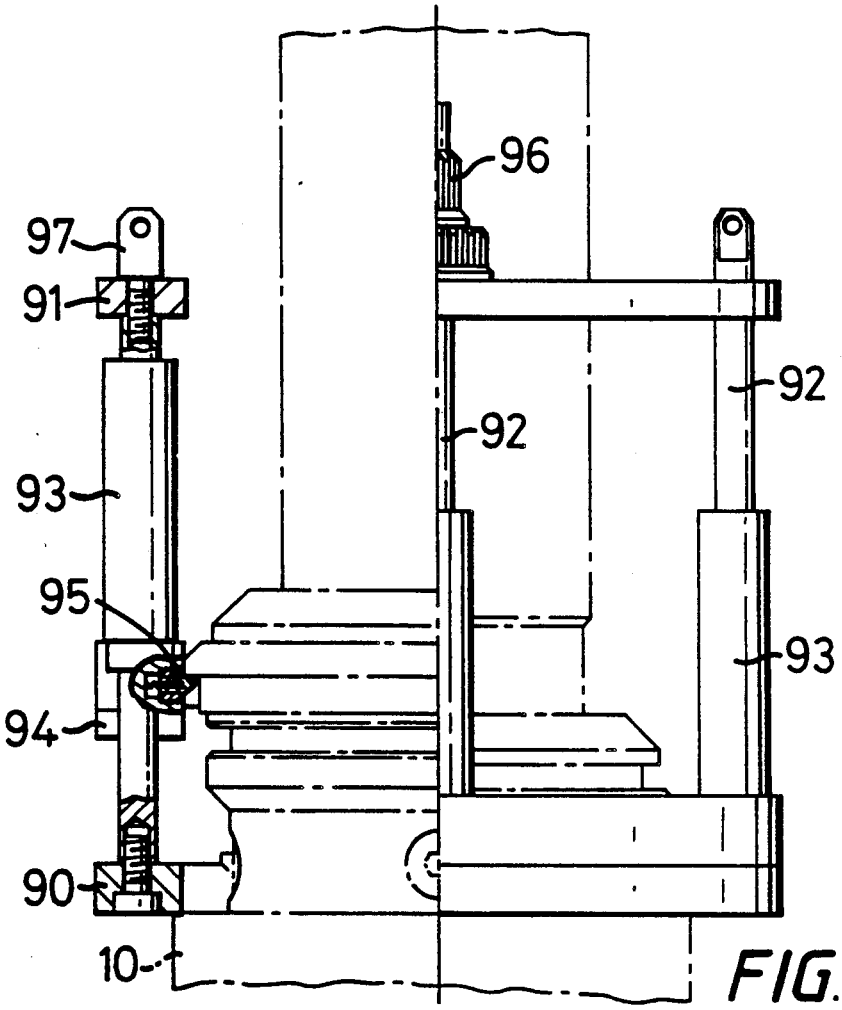
Figure 7C:
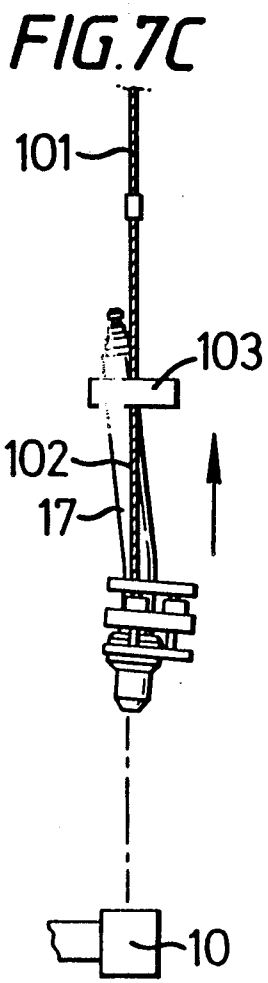
Figure 7B:
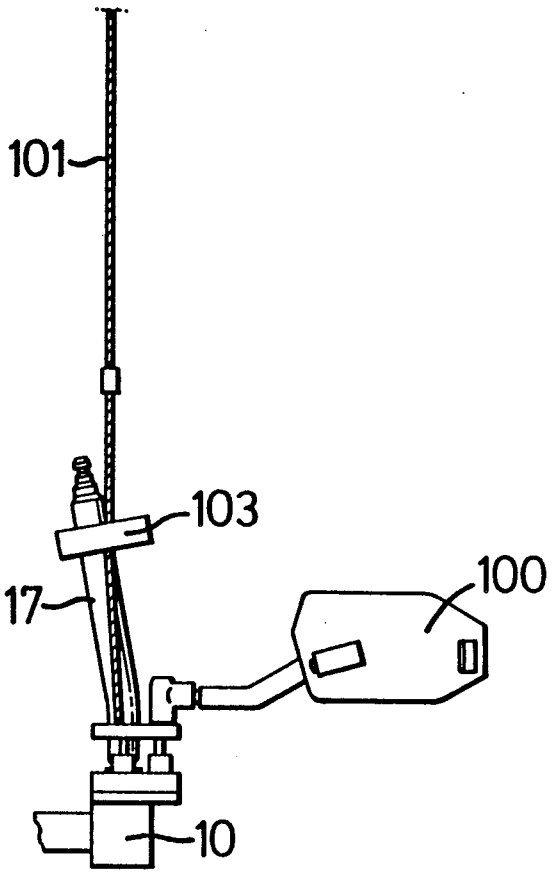
Figure 7A:
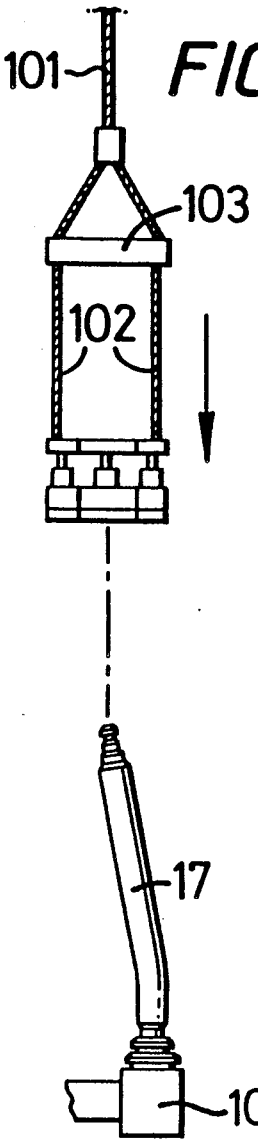

FIG. 7A, 7B and 7C sequence of operations when using the retrieval tool of FIGS. 6A and 6B.

Figure 1:
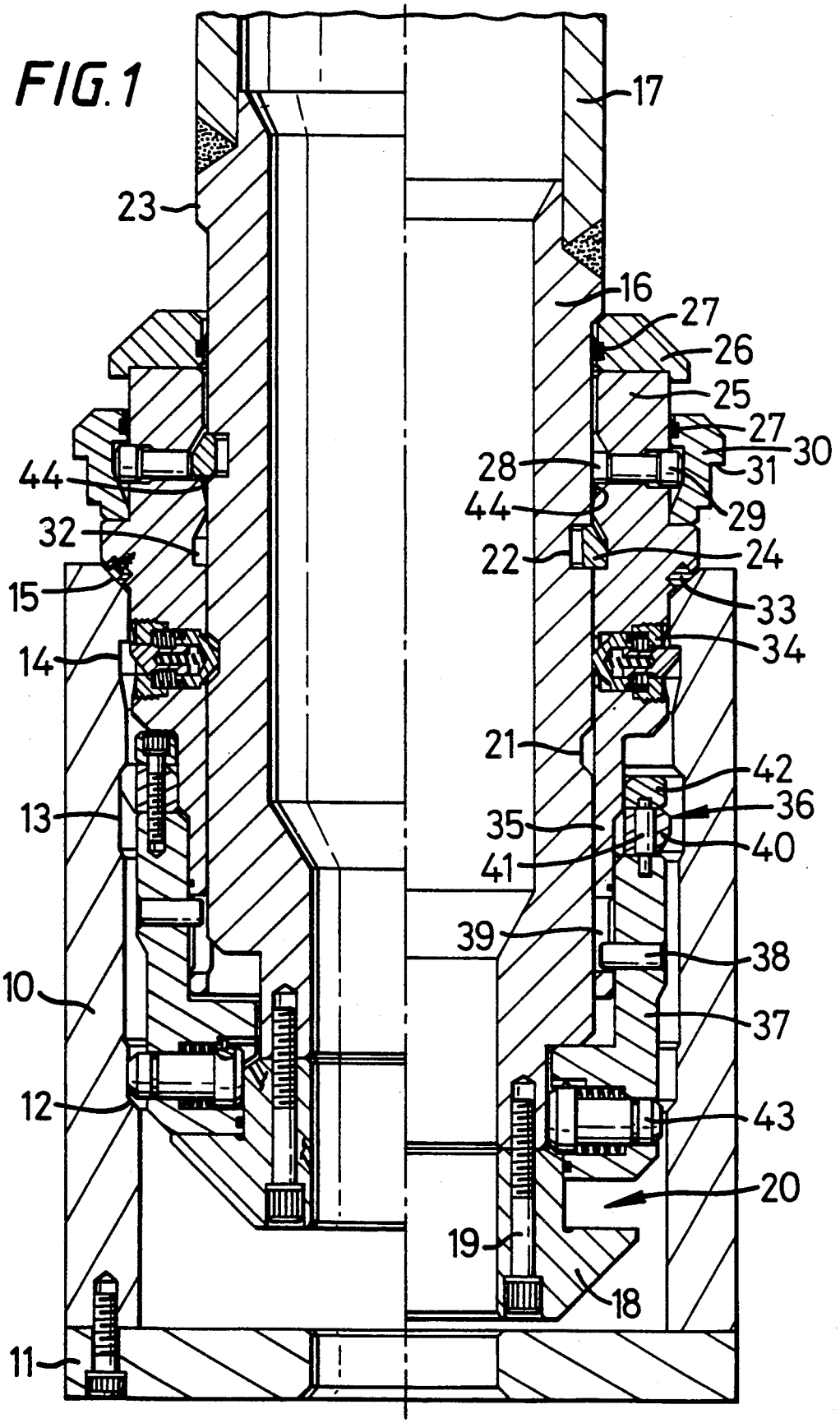

In FIG. 1, guide foot 10 forms part of a guide base, module or any other appropriate part of a sub-sea installation. It is formed of a hollow cylinder fixed to a base plate 11. The inside of the cylinder has, from the bottom up, step 12, shallow groove 13, groove 14 with a horizontal top, and chamfered lip 15.

A guide post end is shown within the guide foot, the right hand side of FIG. 1 showing the end when initally landed, and the left hand side when locked into the guide foot. Guide post end is formed of a hollow upper mandrel 16 (which is welded to the guide post proper 17) and a lower mandrel 18 fixed to upper mandrel 16 by screws 19. The exterior of the mandrels has from the bottom up, a wide, stepped groove 20, chamfered groove 21, right-angled groove 22 and projection 23. Right angled groove 22 contains a bias out male locking split ring 24.

Surrounding upper mandrel 16 is locking sleeve 25, held by retainer ring 26 with lip seals 27. Near the top of locking sleeve 25 is an internal groove 28 with radial holes to the exterior housing a number of unlock pins 29. Pins 29 are surrounded by unlock ring 30. The inside of unlock ring 30 has a chamfered profile for the heads of unlock pins 29 and the outside has a projection giving a horizontal under surface 31. Lip seals 27 seal the top of unlock ring 30 where it contacts locking sleeve 25, and the unlock ring 30 seats on an exterior shoulder of locking sleeve 25.

Continuing down locking sleeve 25, there is an interior groove capable of receiving locking split ring 24, and exterior chamfered shoulder with gasket 33 which seats on lip 15 of guide foot 10. Below this is temporary lock pin assembly 34. The assembly has a number of spring-loaded pins with tapered inner ends capable of fitting into groove 21 of upper guide post mandrel 16 and contoured outer ends capable of fitting into groove 14 of guide foot 10. The pins are spring loaded inwardly.

Locking sleeve 25 terminates in a narrow downward extension 35 which can pass behind the main guide post end locking assembly indicated generally at 36. Assembly 36 is mounted on a compression sleeve 37, which is located by dowel pins 38 fitting into slot 39 at the end of extension 35 of locking sleeve 25. This arrangement locates sleeve 37 relative to locking sleeve 25 but allows it to slide axially relative to the guide post and locking sleeve 25. Locking assembly 36 is the assembly locking the guide post end into the guide foot. It consists of a number of floating segments 40 separated by spacer pins 41 fixed into the top of compression sleeve 37. Locking segment retainer ring 42 holds the head of pins 41. This arrangement holds segments 40 but allows them to move radially into and out of engagement with groove 13 of guide foot 10.

At the foot of compression sleeve 37 are a number of spring loaded radial load pins 43 within grooved area 20 at the junction of upper mandrel 16 and lower mandrel 18.

Figure 2D:
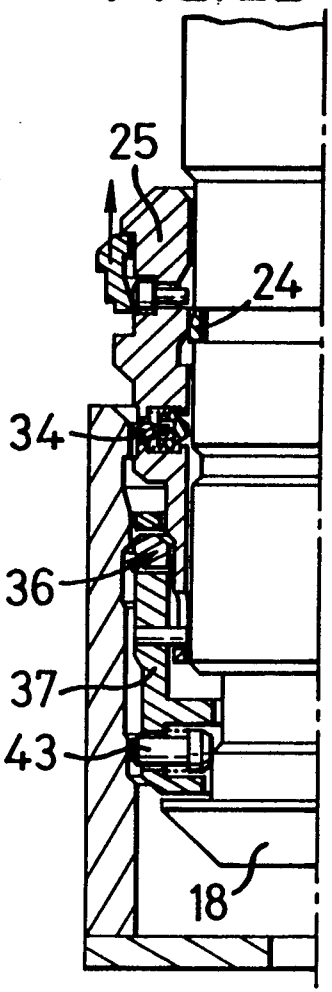
Figure 2C:
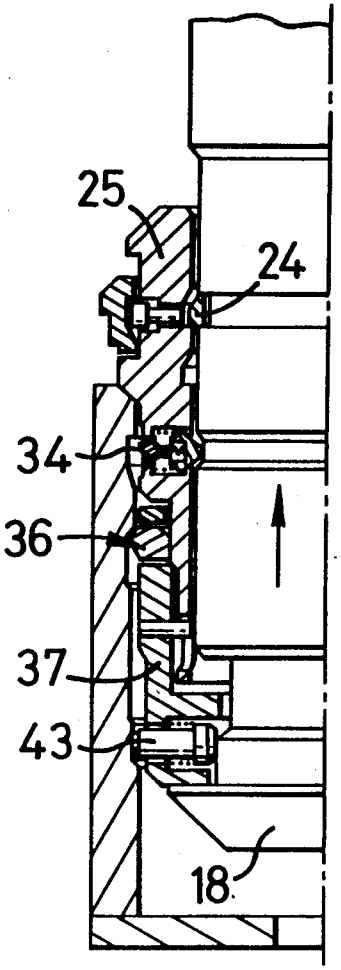
Figure 2B:
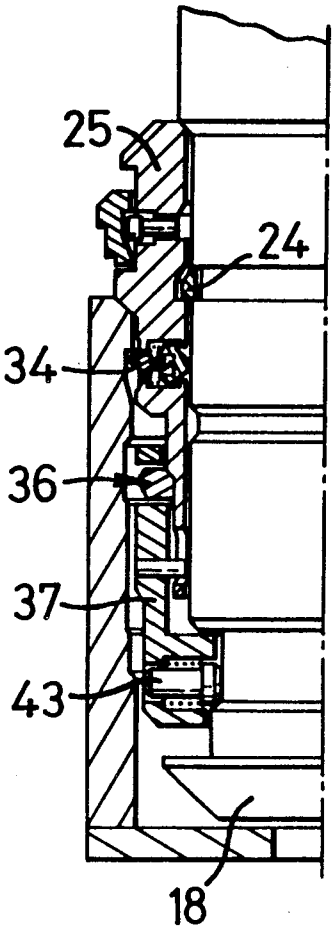
Figure 2A:
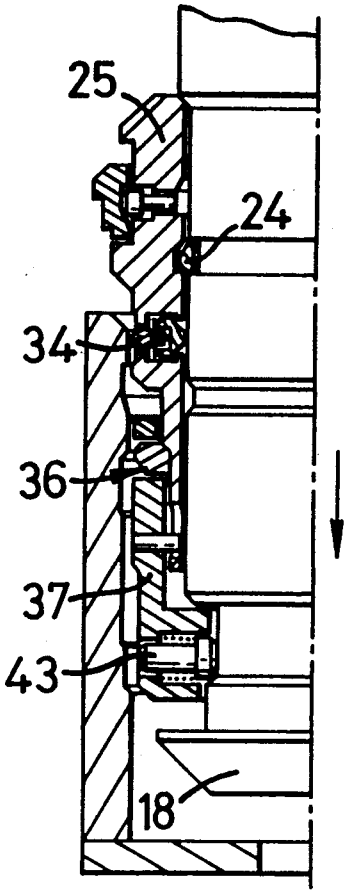

The operation of this automatically re-settable locking system for the guide post end in guide foot 10 will be described with reference to FIG. 1 and to FIGS. 2A, 2B and 2C which show three steps of the locking sequence.

The parts are assembled on a surface vessel in the position shown on the right hand side of FIG. 1. Locking split ring 24 in locking sleeve groove 32 holds the locking sleeve 25 onto the guide post and, at the lower end, dowel pins 38 in slot 39 and radial load pins 43 hold compression sleeve 37.

In operation, the guide post 17 and the guide post end are lowered into guide foot 10 with the various parts in the positions shown on the right-hand side of FIG. 1. The lowering can be done in any convenient manner by using an ROV, by lowering it on a guide line attached to its top, or by lowering it on drill pipe deployed from a surface vessel.

The assembly is lowered until the guide post end begins to enter guide foot 10. The shaped end of lower mandrel 18 is, it will be noted, significantly narrower than the diameter of guide foot 10 so that only rough alignment is required. The guide post and guide post end will still enter even if they are not vertical. The guide post end continues into the guide foot until the position of FIG. 2A is reached, with temporary lock pins 34 contacting the top inside edge of the guide foot 10. Now further downward movement of the guide post will force temporary lock pins 34 inwardly until they reach groove 14 of the guide foot 10 when they will automatically spring into groove 14. This will hold the guide post end loosely in the guide foot. At this point gasket 33 on locking sleeve 25 will have landed on lip 15 of the guide foot 10 sealing the assembly from any infiltration of debris. This is the position of FIG. 2B. None of the other locks is activated nor do they impede the lowering process.

As described above, the assembly has been lowered with the parts in the unlocked position. However, if the assembly has not been so arranged in this way, the downward push of the guide posts to go from FIG. 2A to FIG. 2B will automatically put the parts into the landed position.

The guide post end can now be locked into guide foot 10 by giving an upward pull to guide post 17. Locking sleeve 25, being held in groove 14 of guide foot 10 by temporary lock pins 34 cannot move intially, but the guide post end and compression sleeve 37 can. The first action is for the guide post end to move. This movement lifts compression sleeve 37, because the inside end of radial load pins 43 rest on lower mandrel 18. The upward pull will, thus, move both the guide post end and compression sleeve, so that dowels 38 of compression sleeve 37 move up slot 39 of locking sleeve extension 35. The upward movement of compression sleeve 37 also forces locking segments 40 out as they ride up over locking sleeve 25, until they lodge in the top of groove 13 of guide foot 10. These movements also force radial load pins 43 upwardly and outwardly so that they eventually pass shoulder 12 of guide foot 10. This gives a second point of alignment of the guide post end in the guide foot 10. The final effects of the upward pull are to bring groove 21 of upper mandrel 16 into line with temporary lock pins 34 so that pins 34, being spring loaded, move into groove 21, and to bring locking split ring 24 in groove 22 of upper mandrel 16 into line with groove 28 of locking sleeve 25, so that it moves into groove 28 under its outward bias. Temporary lock pins 34 are thus freed from their temporary engagement with groove 14. Groove 28 has a lead-in taper 44 so that locking split ring 24 keeps a downward pressure on locking sleeve 25 and allows the temporary lock pins 34 to be freed. The final position of the assembly is thus as shown on the left hand side of FIG. 1 and in FIG. 2C. The guide post end is now fully located and aligned in guide foot 10 with two contact points at top and bottom, i.e. by the close fit of locking sleeve 25 in the top of guide foot 10, and by radial load pins 43 contacting the bottom of guide foot 10. Locking segments 40 lock it into groove 13 of guide foot 10.

To release the guide post 17 and the guide post end from guide foot 10, locking sleeve 25 is moved up relative to the guide post end. Upward movement of the locking sleeve 25 is effected by an ROV. Alternatively, if guide post 17 has no guide wire, a tool can be deployed from a surface vessel, the tool having the capability of of exerting upward pressure on the locking sleeve 25. The upward pressure is exerted on bottom surface 31 of unlock ring 30. The first effect of this upward pressure is to move unlock ring 30 up relative to locking sleeve 25 for a distance limited by locking sleeve retainer ring 26. The inside of unlock ring 30 is contoured so that the effect of this upward movement is to push unlock pins 29 inwardly, this in turn pushing locking split ring 24 back into groove 22 of upper mandrel 16. Temporary lock pins 34 are not in groove 14 (this release being efected by the locking action previously described) so further upward force on unlock ring 30 will carry locking sleeve 25 up with it.

Locking sleeve 25 moves up while the guide post end and compression sleeve 37 remain stationary. This means that extension 35 of locking sleeve 25 is brought into alignment with locking segments 40 so that they are free to move inwardly out of groove 13 thereby releasing the guide post end assembly from the guide foot 10. The only parts still in contact with guide foot 10 are the radial load pins 43. This is the position shown in FIG. 2D. Further upward movement of locking sleeve 25 causes the bottom of slot 39 in extension 35 of locking sleeve 25 to make contact with dowel pins 38 of compression sleeve 37. Compression sleeve 37 is thus moved up also freeing radial load pins 43. At this point locking split ring 24 will have moved into groove 32 of locking sleeve 25 thereby locking locking sleeve 25 to the guide post end. The upward movement of locking sleeve 25 is limited by projection 23 of upper mandrel 16.

Now continued upward pressure on locking sleeve 25 and/or an upward pull on guide post 17 will pull the whole assembly out of guide foot 10 against any frictional forces. The net effect of the upward movement of locking sleeve 25 relative to the guide post end will have been to restore the parts to the landed position of the right hand side of FIG. 1. The whole assembly can thus be lifted out of guide foot 10 and transferred to another guide foot on another part of the sea-bed complex. With the parts in the positions as shown on the right-hand side of FIG. 1 the assembly can be lowered into its new guide foot. An upward pull on guide post 17 will then lock it into the new guide foot as previously described.

With the upward pressure on unlock ring 30 discontinued unlock ring 30 should move down under gravity to its original position on locking sleeve 25. However, even if it does not move under gravity this will not matter. The assembly can still be placed into a new guide foot and the locking of the assembly into the new guide foot will automatically bring locking split ring 24 into contact with unlock pins 29 forcing them out. They, in their turn, will force unlock ring 30 downward back onto locking sleeve 25.

FIGS. 1 and 2 show an automatically re-settable guide post which can be moved under water from one part of a sub-sea installation to another. Such re-stabbable guide posts will not normally have guide wires attached, certainly not guide wires extending down the insides of the guide post ends to attachment points lower down. FIG. 1, therefore, shows no guide wire slots in the guide post end.

Figure 3A:
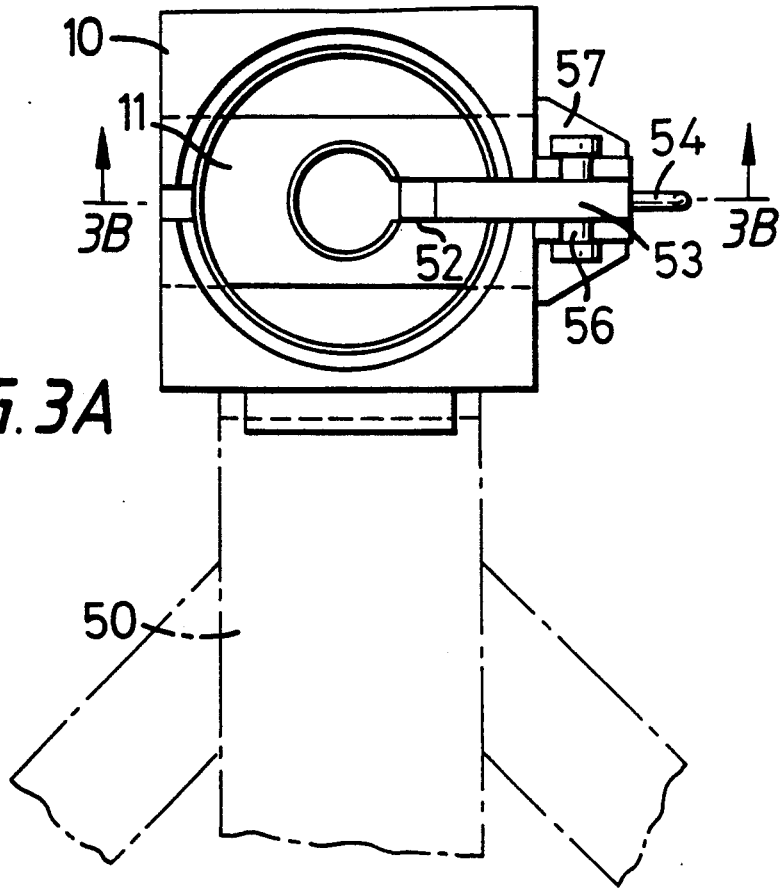
FIG. 3A is a plan view and FIG. 3B a section through a guide foot for use with a guide post end of the present invention.
Figure 3B:
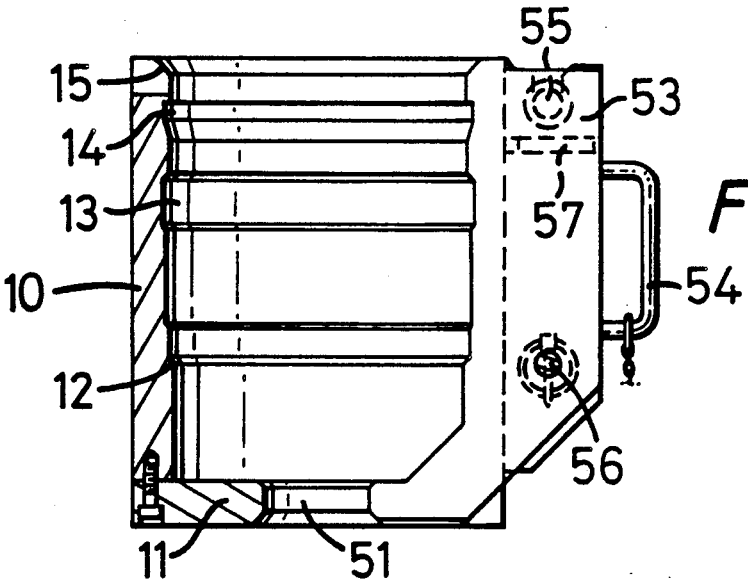

However, guide wire slots may be required in guide feet for guide posts ends which are not movable underwater and FIG. 3 shows such a guide foot. FIG. 3A is a plan view of a guide foot and FIG. 3B a section on line B—B of FIG. 3A.

In FIGS. 3A and B guide foot 10 has base plate 11 as in FIG. 1, the same internal shoulders and grooves 12, 13,14 and the same lip 15. This is for standardisation even though not all the grooves may be required for locking. Guide foot 10 is shown attached by framework 50 to a guide base, which may be the retrievable guide base of UK Patent Application No. 8904123.

It may, however, be part of any other subs-sea component or template requiring guide posts.

A guide wire (not shown) may be attached below base plate 11 passing through hole 51 in it for attachment elsewhere.

One side of guide foot 10 has a longitudinal slot 52 through which a guide wire may be threaded. Slot 52 may be closed by gate 53 with handle 54. The gate may be hinged at its top by hinge pin 55 and, once the guide wire has been inserted, can be locked by bolt 56 between side plates 57 extending out from guide foot 10.

Figure 4:
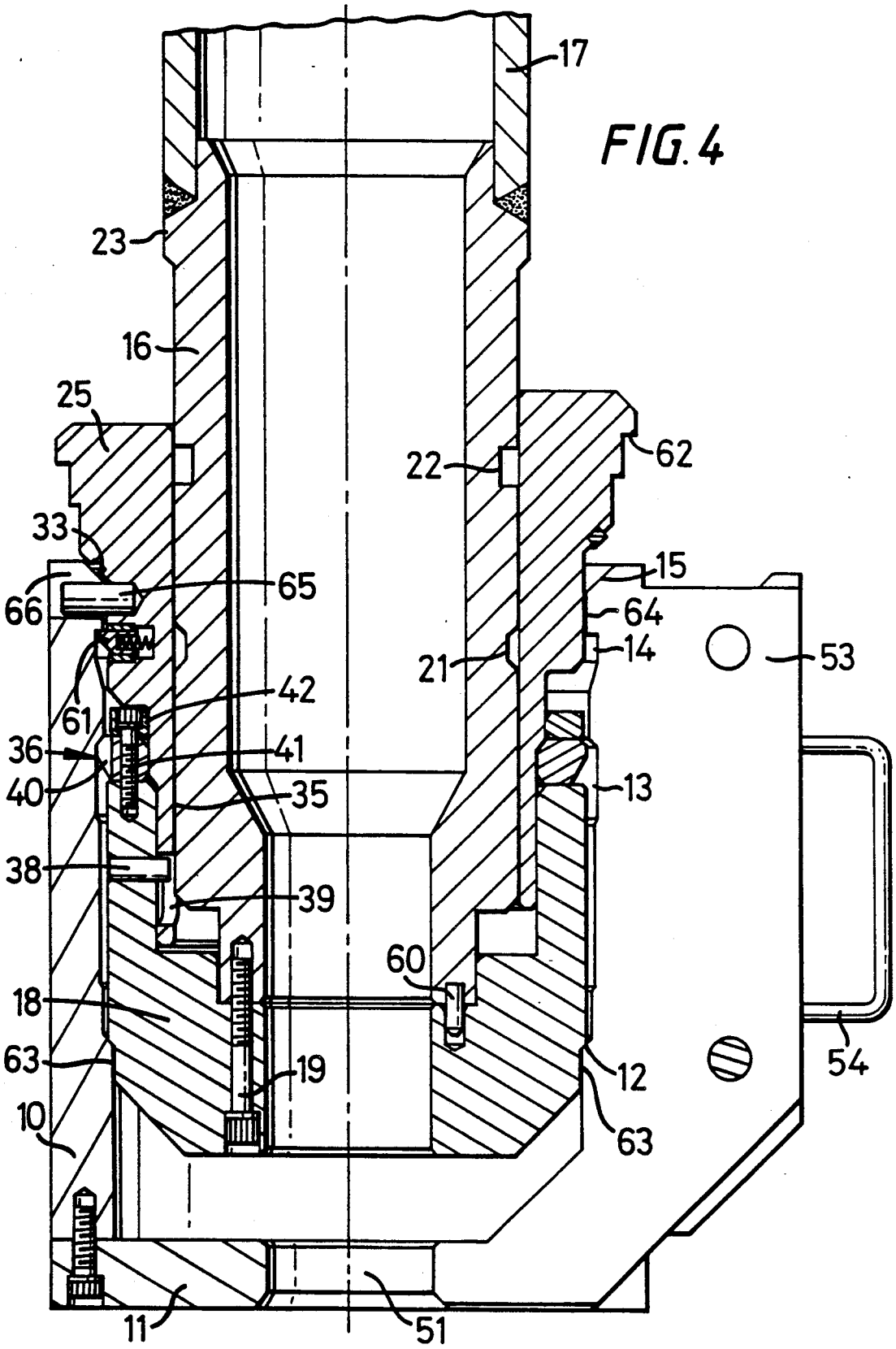
FIG. 4 is a section through the guide foot of FIGS. 3A and 3B containing a non-resettable guide post end of the present invention.

The guide foot of FIG. 3 is suitable for holding a guide post and guide post end as shown in FIG. 1 or for holding a guide post and guide post end with a locking system which is not automatically resettable. Such a guide post end is shown in FIG. 4 in the guide foot of FIG. 3. As previously explained, this much simpler and cheaper version of a guide post end of the present invention can be used in situations where underwater transfer is not required. Its unlocking mechanism will, however, allow it to be removed when no longer required or if it becomes damaged.

Where similar parts are used as in FIGS. 1 and 3 the same reference numerals are used in FIG. 4. The right hand side of FIG. 4 shows the guide post end in the landed, unlocked position and the left hand side shows it in the locked position.

FIG. 4 shows guide post 17 welded to a guide post end formed of upper and lower mandrels 16 and 18 held together by bolts 19. An orientation dowel 60 may be required to ensure proper orientation of the two mandrels. Upper mandrel has, for purposes of standardisation, the same grooves and projections as in FIG. 1, even though they may not be required in this simpler version of the invention. Similarly guide foot 10 has the same internal configuration.

The same basic locking assembly 36 is used in FIG. 1 with locking segments 40, spacer pins 41, and locking segment retainer ring 42. Locking sleeve 25 also has a downward extension 35 extending behind assembly 36.

Locking sleeve 25 has no unlock sleeve and pins and no temporary lock pins. Instead there are spring loaded shear pins 61 in locking sleeve 25 capable of engaging with groove 14 of guide foot 10.

There is no compression sleeve or radial load pins at the base of the assembly. Instead lower mandrel 18 is shaped to extend up and support locking assembly 36. Dowels 38 which were in compression sleeve 37 of FIG. 1 are now in lower mandrel 18 and act as orientation dowels also. These dowels 38 can slide in slot 39 of locking sleeve extension 35.

As previously indicated, the simpler guide post end of FIG. 4 may be used initially on a suitable sub-sea module. It may thus be inserted into and locked into a guide foot of a module on a surface vessel prior to lowering the module to the sea bed. The assembly may thus be set up in the moonpool of the surface vessel used for lowering the module.

Thus in the moonpool the guide foot 10 may be threaded onto a guide wire using slot 52 (as shown in FIG. 3A) and then the guide post and guide post end placed around the guide wire using its slot (not shown).

As the guide post end is designed for surface installation it does not need the coarse and fine alignment features of the guide post end of FIG. 1. Two point alignment is achieved by a machine fit (indicated at 63) between lower mandrel 18 and the bottom end of guide foot 10 and by a similar close fit (indicated at 64) between locking sleeve 25 and the upper part of guide foot 10. An orientation pin 65 fits into the slot 66 on the top of guide foot 10, slot 66 being open at the top. Locking sleeve 25 and the guide post end are thus located in guide foot 10 so that the guide wire slots line up by orientation pin 65 and orientation dowels 38.

In FIG. 4, the guide post is shown in section. In order to show the orientation pin 60 on the right hand side it is necessary to show this out of phase. It is to be understood that when truly aligned this area would form the slot for the guideline to enter.

Although the insertion and locking of the guide post end in the guide foot may be effected on a vessel, the locking still relies on relative movement as between the locking sleeve and the guide post end. The right hand side of FIG. 4 shows the position of the parts for insertion and the left hand side shows them locked. The relative movement is thus not upward movement of the guide post end, but downward movement of locking sleeve 25 so that shear pins 61 are aligned with and enter groove 14. At the same time the contour of locking sleeve 25 behind locking assembly 36 is such that locking segments 40 are forced out into the top of groove 13. The guide post end is thus locked into the guide foot as shown in the left hand side of FIG. 4.

Shear pins 61 are equivalent to the temporary lock pins 34 of FIG. 1 but they are not temporary in the sense that they are freed by the locking action. They are temporary in the sense that they have to be sheared as the initial step in the unlocking operation.

Unlocking is effected by pulling up on locking sleeve 25 with a force sufficient to shear pins 61. The pull up on locking sleeve 25 may be effected by a suitable tool pressing up on the under surface 62 of locking sleeve 25. This gives locking sleeve 25 the freedom to move up relative to the guide post and to the landed position which frees segments 40 and unlocks the guide post end from the guide foot. Further upward force will lift the guide post end out of the guide foot, against the frictional forces of the alignment surfaces. Orientation pin 65 will lift out of open slot 66.

The guide post and guide foot end can now be pulled clear of the guide foot and drawn up to the surface. If there is any damage this can be repaired on the surface, but, in any case, before the guide post end is fit for re-use, sheared shear pins 61 have to be replaced by fresh pins.

Figure 5A:
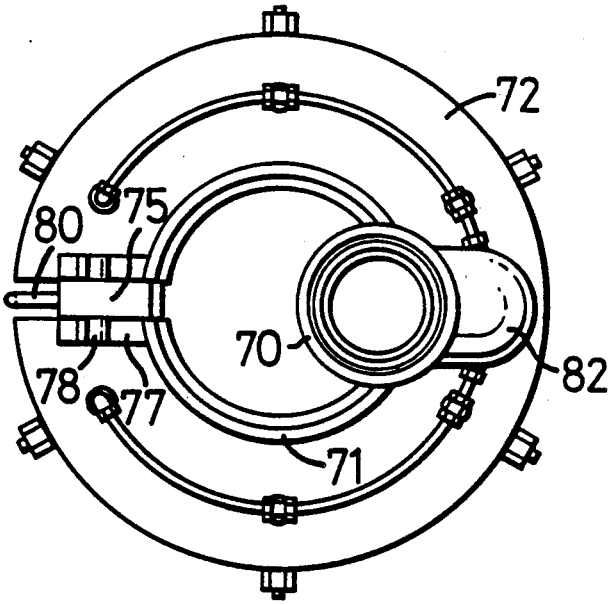
FIG. 5A is a plan view and FIG. 5B a partially sectioned view of a guide post retrieval tool run from the surface.
Figure 5B:
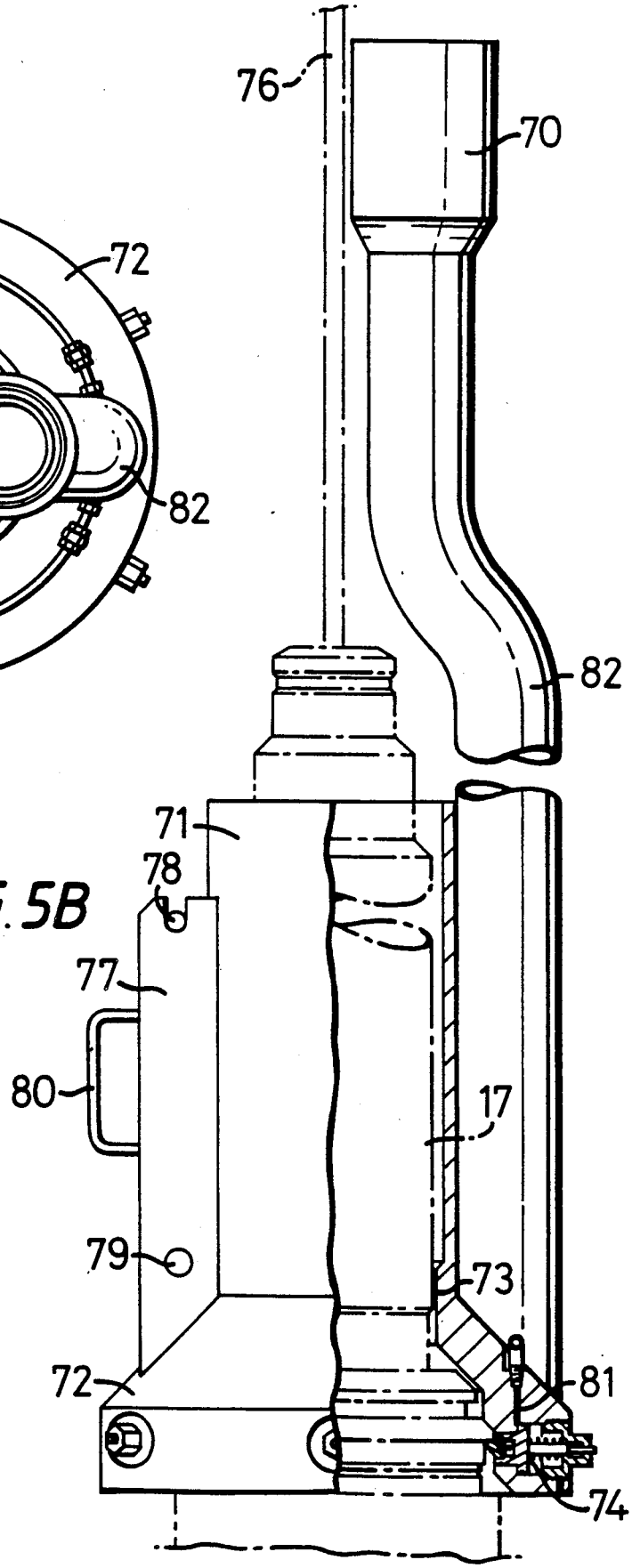

FIGS. 5A and 5B are, respectively, a plan and part sectioned elevation of a retrieval tool for a guide post. This particular tool is designed to be used either at the end of a drill pipe or a lifting line. It may be run down a guide wire or positioned over a guide post with the assistance of a ROV.

As shown it has connection 70 for attachment to a drill pipe, but the connection could be adapted for a lifting line. If the tool is designed for use in the transfer of posts underwater using the design of FIG. 1, a drill pipe is preferred, as hydraulic pressure is required, but even here a lifting line could be used with a hydraulic fluid umbilical or a hydraulic cylinder on the tool itself. It has a sleeve 71 designed to fit over a guide post and a flared skirt 72 to provide initial guidance onto the post as the tool is lowered. A waist portion 73 is only slighter wider than the guide post and so provides close guidance and alignment of the tool on the post. The tool has a number (e.g. 6) of dogs 74 spring loaded inwardly, these dogs being designed automatically to engage with locking groove 25. Thus they are designed to fit around and bear up on surface 31 of unlock sleeve 30 (FIG. 1) or on surface 62 of locking sleeve 25 (FIG. 4). The dogs may incorporate high strength shear pins as a safety feature so that if the post were to be firmly stuck in the guide foot, structural damage would not be caused to the sea-bed unit when pulling up.

As with the guide foot of FIG. 3, the tool of FIG. 5 has a vertical slot 75 to allow it to be placed around a guide wire 76 and this slot can be closed by a stop plate 77 with handle 80 hung on hinge 78 and held by a bolt 79.

Although the tool of FIG. 5 is shown with a guide slot being lowered around a guide wire, it is equally suitable for use with guide posts having no guide wires. It can, however, only be used with a guide post that is still substantially straight.

In operation, it will be seen that spring loaded dogs 74 will automatically pass over and then engage under surface 31 (FIG. 1) or under surface 62 (FIG. 4). Pulling the tool upwardly will thus give the required upward pull on locking sleeve 25 of either type of guide post end. The simple guide post end of FIG. 4 can be brought by the tool back to the surface. The tool may, however, be used to transfer the automatically re-settable guide post end of FIG. 1. The tool transfers the guide post end to a position above the new guide foot and lowers it in. The guide post end can then be locked by an upward pull on the guide post, using, e.g., the guide wire if the post has one. The locking sequence will be as previously explained with reference to FIG. 1. Dogs 74 of the tool may then be freed from engagement with unlock ring 30. They are freed by hydraulic pressure supplied through passage 81 forcing the dogs outwardly against the spring pressure. The hydraulic fluid can be supplied, as previously explained, down drill pipe and through drill pipe connection 70 and pipe 82, or through a hydraulic fluid umbilical or from a hydraulic cylinder on the tool.

Once the dogs 74 have been freed the tool can be pulled up to clear locking sleeve 25.

FIGS. 6A and 6B are, respectively, a plan and partially sectioned elevation of another retrieval tool for a guide post. As previously explained the tool of FIG. 5 can only be used if the guide post is still substantially straight. The tool of FIG. 6 is designed to be operated by a ROV and, as shown in FIG. 7, can be used on bent or damaged guide posts.

In FIGS. 6A and 6B, the tool has a horse shoe shaped lower partial ring 90 which can sit on the top of a guide foot 10. It has also an upper partial ring 91, joined by three rods 92. Surrounding these rods are three hydraulic cylinders 93 having attached to their bases a further unlock partial ring 94 with spring loaded latch dogs 95, similar to those of the tool of FIG. 5. Movement of cylinder 93 up and down rods 92 will thus lift and lower unlock ring 94 with its dogs 95. One of the cylinders 93 has a ROV spigot 96 at its top so that hydraulic pressure can be supplied from an ROV.

Upper partial ring 91 has two lifting eyes 97 and there are grabber arms 98 with tension springs 99 at the ends of lower partial ring 90.

FIGS. 7A, 7B and 7C show three stages of the use of the tool of FIG. 6. They show, in addition, a bent guide post 17, a ROV 100 to guide and operate the tool, and lifting lines 101, 102 for the tool with a collar 103.

The operation of the tool will be described with reference to FIGS. 6 and 7. FIG. 7A shows the tool being lowered towards a bent guide post 17. ROV 100 is attached to spigot 96 (see FIG. 7B) before collar 103 passes over the top of guide post 17 so that there is ROV assistance for this step. When the tool has reached the level indicated in FIG. 7B, ROV 100 moves the tool horizontally to surround the guide post. Grabber arms 98 are pushed aside but spring back under the force of tension springs 99 to grasp the guide post firmly. The tool rests on the top of guide foot 10, which provides reaction for the hydraulic pressure applied through the cylinders.

With the tool in the position of FIG. 7B, spring loaded dogs will be in engagement with locking sleeves 25 exactly as for the tool of FIG. 5 (i.e. bearing against under surface 31 of unlock ring 30 (FIG. 1) or under surface 62 (FIG. 4)). Cylinders 93 will be at the bottom of their travel. Hydraulic fluid pressure may now be applied from the ROV through spigot 96. Each cylinder will have a piston in it fixed to and surrounding each rod and the cylinders will be full of fluid when the tool is deployed. The cylinders may be connected up in series, with a line from the spigot to the top of one cylinder, an outlet from the bottom of this cylinder to the top of the next, and an outlet from the bottom of this cylinder to the top of the third. The bottom of the third cylinder can either be vented to atmosphere or, preferably, may be connected to a return line.

This system ensures that an even pressure is applied to all three cylinders. Thus, assuming a pressure of 3000 psi from the ROV there may be a differential of 1000 psi across the piston of the first cylinder, the underside pressure being 2000 psi. This will be the pressure in the top of the second cylinder, and the same differential will give an underside pressure of 1000 psi in the second cylinder. In the third cylinder the top pressure of 1000 psi will be balanced across the piston with 0 psi outlet pressure, so that each piston and cylinder will have the same differential pressure of 1000 psi and equal volumetric displacements.

Since the tool is firmly seated on guide foot 10, the pressure will move cylinders 93 up rods 92 taking with them unlock partial ring 94 and dogs 95. Dogs 95 bearing against the undersurface will thus push up locking sleeves 25 (FIGS. 1 and 4) and so release the guide post and guide post end from the guide foot. ROV 100 can now be disconnected and the damaged guide post 17 drawn up to the surface by lifting line 101 as shown in FIG. 7C.

The tool of FIGS. 6 and 7 is shown dealing with a damaged guide post. However, the fact that the tool is placed around a guide post horizontally means that it can be used in a variety of situations. Thus it could be used to remove and reinstall a guide post on a new well slot of a multi-well template underneath a BOP stack without the need to remove the BOP and bring it to the surface. In such a situation it must be assumed that the post has a guide line to take the weight of the post. The tool instead of being attached to lifting lines can be free moving with flotation foam to give it neutral buoyancy, and it can be manoeuvred solely by a ROV.

The tool can be removed from engagement with the guide post end at any time simply by re-setting the cylinders and moving it horizontally away from the guide post end. The hydraulic cylinders can be re-set and the unlock partial ring 94 restored to its original position by applying hydraulic fluid pressure to the outlet line at the bottom of the third cylinder.

A feature of all the designs described in this application is the lack of cavities in the locking and unlocking mechanisms, and hence no places where debris or silt could accumulate to adversely affect the unlocking capabilities of the system.

I claim:

1. A removable guide post assembly suitable for subsea oil or gas installation comprising
   (a) a guide foot having a vertical hole to receive the end of a guide post, said foot having at least two horizontal grooves on its inner surface;
   (b) a guide post end capable of fitting within the guide foot and having locking means selected from a ring and segments of a ring adapted to fit into one of the horizontal grooves of the guide foot;
   (c) a locking sleeve surrounding the guide post end capable of relative axial movement with respect to the guide post end;
   (d) temporary sleeve locking means on the locking sleeve adapted to fit into the other horizontal groove of the guide foot.

2. A removable guide post assembly as claimed in claim 1 wherein the locking means is automatically reset by the upward movement of the locking sleeve.

3. A removable guide post assembly as claimed in claim 2 wherein the temporary locking means are spring loaded lock pins which are released from their temporary lock by the locking upward movement of the guide post end.

4. A removable guide post assembly as claimed in claim 2 having locking means as between the guide post end and the locking sleeve.

5. A removable guide post assembly as claimed in claim 4 wherein the locking means is a locking split ring movable by locking pins between a circumferential groove in the guide post end and an inner groove in the locking sleeve.

6. A removable guide post assembly as claimed in claim 5 wherein the locking pins are surrounded by an unlock ring which has a surface for applying pressure for the upward movement of the locking sleeve.

7. A removable guide post assembly as claimed in claim 2 wherein the guide post end has radial load pins capable of contacting the inner surface of the guide foot and providing additional locking means.

8. A removable guide post assembly as claimed in claim 1 wherein the locking means is not automatically reset by the upward movement of the locking sleeve.

9. A removable guide post assembly as claimed in claim 8 wherein the temporary locking means are spring loaded shear pins.

10. A tool for unlocking a removable guide post assembly as claimed in claim 1 comprising
   (a) a hollow cylinder open at its lower end adapted to fit over the guide post,
   (b) spring loaded latching dogs at the end of the cylinder adapted to automatically latch onto the locking sleeve, and
   (c) means to unlatch the dogs from the locking sleeve, so that moving the tool upwardly moves the locking sleeve upwardly.

11. A tool for unlocking a removable guide post assembly as claimed in claim 1 comprising
   (a) a partial ring capable of partially surrounding a locking sleeve and of seating on a guide foot, (b) a second partial ring above the first ring capable of partially surrounding a locking sleeve and having spring loaded latching dogs adapted to automatically latch onto the locking sleeve, and (c) means for raising the second ring relative to the first ring and hence move the locking sleeve upwardly.

12. A tool for unlocking a removable guide post assembly as claimed in claim 11 wherein the means for raising the second ring is a number of hydraulic pistons and cylinders.

* * * * *